US009604837B2

(12) United States Patent
Brown et al.

(10) Patent No.: US 9,604,837 B2
(45) Date of Patent: Mar. 28, 2017

(54) ORVR VALVE ASSEMBLY

(71) Applicants: Robin J. Brown, Labadie, MO (US); Arthur C. Fink, Lonedell, MO (US)

(72) Inventors: Robin J. Brown, Labadie, MO (US); Arthur C. Fink, Lonedell, MO (US)

(73) Assignee: Husky Corporation, Pacific, MO (US)

( * ) Notice: Subject to any disclaimer, the term of this patent is extended or adjusted under 35 U.S.C. 154(b) by 571 days.

(21) Appl. No.: 13/694,779

(22) Filed: Jan. 7, 2013

(65) Prior Publication Data

US 2013/0180600 A1 Jul. 18, 2013

Related U.S. Application Data

(60) Provisional application No. 61/631,557, filed on Jan. 6, 2012.

(51) Int. Cl.
*B67D 7/04* (2010.01)

(52) U.S. Cl.
CPC ..... *B67D 7/048* (2013.01); *B67D 7/0478* (2013.01); *Y10T 137/3084* (2015.04)

(58) Field of Classification Search
CPC .... B67D 7/048; B67D 7/0478; B67D 7/0476; Y10T 137/3084
USPC .... 141/46, 59, 287, 301, 302; 251/281, 282, 251/330, 331
See application file for complete search history.

(56) References Cited

U.S. PATENT DOCUMENTS 3,534,768 A * 10/1970 Powell ..... 137/496
3,823,733 A * 7/1974 DuBois et al. ..... 137/496
4,056,131 A 11/1977 Healy
4,057,085 A * 11/1977 Shihabi ..... 141/59
5,035,271 A 7/1991 Carmack et al.
5,040,577 A 8/1991 Pope
5,141,037 A 8/1992 Carmack et al.
5,188,141 A * 2/1993 Cook et al. ..... 137/112
5,191,870 A * 3/1993 Cook ..... F02M 25/0809 123/198 D
5,197,523 A 3/1993 Fink, Jr. et al.
5,285,744 A 2/1994 Grantham et al.
5,289,856 A * 3/1994 Strock ..... B67D 7/0476 141/206

(Continued)

*Primary Examiner* — Timothy L Maust
*Assistant Examiner* — Andrew Stclair
(74) *Attorney, Agent, or Firm* — Paul M. Denk

(57) ABSTRACT

An ORVR valve assembly operative of relatively few movable components includes a valve body, having conduits to provide for routine passage of vapors therethrough through operations of a vacuum assist system. This is when a non-ORVR vehicle is being replenished with fuel. But, when a vehicle equipped with ORVR vapor recovery is being fueled, vacuum is generated above a piston supported diaphragm, attracts the diaphragm upwardly, plugs off the vapor passage conduits, and allows the ORVR system of the automobile to exclusively treat the generated vapors at the location of the vehicle and its fuel tank. Simultaneously, air is vented into the valve body, below its diaphragm, and into the vapor return line of the vacuum assist system, to prevent it from being subject to excessive vacuuming. Thus, vapor recovery or treatment can be achieved through the use of the ORVR valve assembly of this invention, regardless whether the automobile being refueled is an ORVR equipped vehicle, or one that is not equipped with vapor recovery.

4 Claims, 3 Drawing Sheets

(56) References Cited

U.S. PATENT DOCUMENTS

| | | | | |
|---|---|---|---|---|
| 5,537,911 | A | 7/1996 | Ohlrogge et al. | |
| 5,564,466 | A * | 10/1996 | Aoyama et al. | 137/493.8 |
| 5,570,015 | A * | 10/1996 | Takaishi et al. | 324/207.21 |
| 5,592,963 | A | 1/1997 | Bucci et al. | |
| 5,592,979 | A | 1/1997 | Payne et al. | |
| 5,620,031 | A | 4/1997 | Dalhart et al. | |
| 5,626,649 | A | 5/1997 | Nanaji | |
| 5,636,667 | A | 6/1997 | Young et al. | |
| 5,655,576 | A | 8/1997 | Leininger et al. | |
| 5,676,181 | A | 10/1997 | Healy | |
| 5,678,614 | A | 10/1997 | Grantham | |
| 5,720,325 | A | 2/1998 | Grantham | |
| 5,765,603 | A | 6/1998 | Healy | |
| 5,782,275 | A | 7/1998 | Hartsell, Jr. et al. | |
| 5,803,136 | A | 9/1998 | Hartsell, Jr. | |
| 5,843,212 | A | 12/1998 | Nanaji | |
| 5,857,500 | A | 1/1999 | Payne et al. | |
| 5,860,457 | A | 1/1999 | Andersson | |
| 5,871,651 | A | 2/1999 | McSpadden | |
| 5,878,725 | A * | 3/1999 | Osterbrink | 123/516 |
| 5,944,067 | A | 8/1999 | Andersson | |
| 5,988,232 | A | 11/1999 | Koch et al. | |
| 6,059,856 | A | 5/2000 | Ohlrogge et al. | |
| 6,070,156 | A | 5/2000 | Hartsell, Jr. | |
| 6,082,415 | A | 7/2000 | Rowland et al. | |
| 6,095,204 | A | 8/2000 | Healy | |
| 6,102,085 | A | 8/2000 | Nanaji | |
| 6,103,532 | A | 8/2000 | Koch et al. | |
| 6,123,118 | A | 9/2000 | Nanaji | |
| 6,151,955 | A | 11/2000 | Ostrowski et al. | |
| 6,332,483 | B1 | 12/2001 | Healy | |
| 6,334,470 | B2 | 1/2002 | Healy | |
| 6,532,999 | B2 | 3/2003 | Pope et al. | |
| 6,546,954 | B2 * | 4/2003 | Sato et al. | 137/496 |
| 6,810,922 | B1 * | 11/2004 | Grantham | 141/59 |
| 7,174,926 | B1 | 2/2007 | Grantham | |
| 7,509,982 | B2 | 3/2009 | Grantham | |
| 8,167,003 | B1 * | 5/2012 | Clever et al. | 141/5 |
| 2007/0193648 | A1 * | 8/2007 | Grantham | 141/59 |
| 2012/0145006 | A1 * | 6/2012 | Schroeder et al. | 96/113 |

* cited by examiner

ORVR VALVE ASSEMBLY

CROSS REFERENCE TO RELATED APPLICATION

This non-provisional patent application claims priority to the provisional patent application having Ser. No. 61/631,557, filed on Jan. 6, 2012.

FIELD OF THE INVENTION

This invention relates to vapor control during dispensing of fuel, and more specifically pertains to a valve assembly that provides for routine operations of a vacuum assist dispensing system, but disengages that system when a vehicle using an ORVR system is employed during fuel dispensing.

BACKGROUND OF THE INVENTION

Various types of valves have been designed and constructed for operating in conjunction with the vacuum assist return of fuel vapors to the underground storage tank, during dispensing of fuel to vehicles, and other types of valve in arrangements have been devised for working in conjunction with the fuel lines, such as closure valves that function to seal off the dispensing of fuel when someone may unwittingly drive away from with the service station, not realizing that the dispensing nozzle may yet be inserted within the fill pipe of their automobile gasoline tank.

In addition, there are valving structures that are used in combination with the ORVR dispensing of fuel, of a vehicle that is equipped with ORVR type of vapor recovery, all at the same time, allowing the dispenser and its vacuum assist collection of vapors to continue to operate, when the vehicle into which fuel is being dispensed does not incorporate an ORVR system.

There are a myriad of examples of various dispensing nozzles, the fuel lines, and other structures related to the dispensing of fuel that provides for alternate operations of vapor recovery systems, when fuel is being dispensed to vehicles that may include an ORVR system, or to one that does not incorporate that type of system.

As an example of prior art patents that show technology relating to the method for handling ORVR (on-board vapor recovery) systems, can be seen in the United States patent to Grantham, U.S. Pat. No. 6,810,922, which provides for a sliding valve member, within a valve body, capable of allowing consecutively the operations of a fuel dispensing system to either a non-ORVR equipped vehicle, or to an automobile that incorporates the ORVR system of vapor removal. Generally, the system incorporates a valve member that is slidable within a passage that also function as an air bleed hole, generally during the refueling of an ORVR equipped vehicle.

Another patent to Grantham, U.S. Pat. No. 7,174,926, shows a very related type structure, with its own style of valve system, but once again, bleeds air into its system through the same air passage in which the valve stem shifts, depending upon whether a non-ORVR vehicle is being refueled, or one that is equipped with the ORVR system of vehicle refueling.

A third patent to Mr. Grantham, U.S. Pat. No. 7,509,982 shows related type of structure to the two previously defined patents, and which incorporates a different style of valve assembly, but generally one which shifts its valve assembly within the same passage that functions as the bleed passage for the valve assembly, during the refueling of the different style of vehicles.

It is to be noted that these bleed passages as shown in these three previous patents all open their shiftable valve assemblies, within the same passage that functions as the air bleed passage, and therefore, can allow the introduction of moisture, rain, and other debris into the same passage in which its valve assembly shifts, which can lead towards corrosion or other deterioration.

Various other methods for controlling vapor in fuel dispensing nozzles can be seen in the U.S. Pat. No. 4,056,131, to Healy. It also shows vapor recovery through locations of a diaphragm, for return back through the nozzle apparently to an underground storage tank.

The patent to Shihabi, U.S. Pat. No. 4,057,085, shows another vapor recovery system, incorporating a diaphragm.

The patent to Carmack, et al, U.S. Pat. No. 5,035,271, shows a vapor recovery fuel dispensing nozzle, also for providing for the collections of fuel vapors.

The patent to Pope, U.S. Pat. No. 5,040,577, shows a vapor recovery system also for fuel dispensing.

A further patent to Carmack, et al, U.S. Pat. No. 5,141,037, additionally shows vapor recovery incorporated within a fuel dispensing nozzle.

The patent to Fink, Jr., et al, U.S. Pat. No. 5,197,523, discloses a dispensing nozzle incorporating an improvement for extracting fuel that may accumulate within the vapor recovery line.

A patent to Grantham, et al, U.S. Pat. No. 5,285,744, shows a coaxial hose assembly for fuel dispensing and apparently vapor recovery.

A patent to Ohlroggee, et al, U.S. Pat. No. 5,537,911, discloses a method and device for separating gas mixtures formed above liquids. This has to do with the underground storage container for the fuel, and to where vapor pressures are returned in contemporary fuel dispensing systems.

The patent to Bucci, et al, U.S. Pat. No. 5,592,963, shows a control valve and system for a fuel vapor recovery system.

The patent to Payne, et al, U.S. Pat. No. 5,592,979, shows another vapor recovery system for a fuel delivery system.

A patent to Dalhart, et al, U.S. Pat. No. 5,620,031, shows a complex vapor recovery fuel nozzle, and its structure for operation.

The patent to Nanaji, U.S. Pat. No. 5,626,649, discloses a volatile organic chemical tank ullage pressure reduction system.

The patent to Young, et al, U.S. Pat. No. 5,636,667, discloses means for conversion of fuel dispensers to provide for vacuum assisted vapor recovery.

A patent to Leininger, et al, U.S. Pat. No. 5,655,576, shows vapor recovery nozzles and subassemblies incorporated therein.

The patent to Healy, U.S. Pat. No. 5,676,181, shows another vapor recovery system accommodating ORVR vehicles. It also incorporates various passages, and the diaphragm, for functioning to achieve vapor recovery, or not, when an ORVR vehicle is being refueled.

The patent to Grantham, U.S. Pat. No. 5,678,614, shows a vapor recovery hose assembly and the Venturi pump therefor.

The coaxial hose assembly for vapor assist fuel dispensing system is shown in the United States Patent U.S. Pat. No. 5,720,325, to Grantham.

Another patent to Healy, U.S. Pat. No. 5,765,603, shows a monitoring fuel vapor flow in a vapor recovering system. This shows what type of vapor recovery is being accomplished.

The patent to Hartsell, Jr., et al, U.S. Pat. No. 5,782,275, shows on-board vapor recovery detection, for a fuel dispensing system.

The patent to Hartsell, Jr., U.S. Pat. No. 5,803,136, shows a fuel tank ullage pressure reduction system.

Another patent to Nanaji, U.S. Pat. No. 5,843,212, discloses fuel tank ullage pressure reduction system.

A patent to Payne, et al, U.S. Pat. No. 5,857,500, discloses the system and method for testing for error conditions in a fuel vapor recovery system.

The patent to Andersson, U.S. Pat. No. 5,860,457, discloses gasoline vapor recovery system and method utilizing vapor detection.

The patent to McSpadden, U.S. Pat. No. 5,871,651, shows electronic filter status sensor for fuel dispensing.

The patent to Andersson, U.S. Pat. No. 5,944,067, shows another vapor recovery system and method. These disclose the dispensing of gasoline from the fuel storage tank, and apparently the return of vapors into said tank.

The patent to Koch, et al, U.S. Pat. No. 5,988,232, discloses vapor recovery system employing oxygen detection.

The patent to Ohlrogge, et al, U.S. Pat. No. 6,059,856, shows a method and apparatus for reducing emissions from breather lines of storage tanks.

A patent to Hartsell, Jr., U.S. Pat. No. 6,070,156, provides traction estimates in a fueling and retail fuel dispensing system.

The vapor recovery diagnostic testing system, shown in U.S. Pat. No. 6,082,415, provides a system for monitoring and testing the operation of a vapor recovery system, as disclosed in its patent U.S. Pat. No. 6,082,415.

The patent to Healy, U.S. Pat. No. 6,095,204, shows another vapor recovery system accommodating ORVR vehicles.

The patent to Nanaji, U.S. Pat. No. 6,102,085, shows hydrocarbons vapor sensing means within a fuel dispensing system.

The patent to Koch, et al, U.S. Pat. No. 6,103,532, shows vapor recovery system utilizing a fiber-optic sensor to detect hydrocarbon emissions.

Another patent to Nanaji, U.S. Pat. No. 6,123,118, shows therein a method for vapor recovery during fuel dispensing.

The patent to Ostrowski, et al, U.S. Pat. No. 6,151,955, shows a device and method for testing a vapor recovery system.

The patent to Healy, U.S. Pat. No. 6,332,483, shows a coaxial vapor flow indicator with pump speed control.

The patent to Healy, U.S. Pat. No. 6,334,470, shows a coaxial vapor flow indicator with pump speed control.

Finally, the patent to Pope, et al, U.S. Pat. No. 6,532,999, shows a pressure sensor for a vapor recovery system.

These are many examples of the type of prior art systems that incorporate means for detection of vapors, either their return by a vacuum assist system, or for accommodating ORVR on-board vapor removal, and various types of flow lines, air passages, diaphragms, and other structures for allowing the operations of these types of fuel dispensing systems.

SUMMARY OF THE INVENTION

The current invention is designed to be used in conjunction with the dispensing of gasoline to vehicles, which may incorporate an ORVR system, where vapor recovery takes place on-board of the vehicle, and does not require any vacuum assist or balanced pressure type of vapor recovery, as done in prior systems. But, since the vacuum assist, and the balanced pressure, are still utilized in many installations, and even through many vehicles are now equipped with the ORVR system of vapor recovery, there still needs to be an adjustment to the overall dispensing system, that can bypass particularly the vacuum assist system, when the vehicle being filled with fuel incorporates its own ORVR vapor recovery system.

With this current invention, this valve is incorporated into the vapor recovery line of the vacuum assist vapor recovery system. It incorporates a valve body, that has a stepped passage provided therethrough, and through which the vapors are drawn from the vicinity of the fill pipe of the vehicle, and normally allows the vapors to be drawn back into the dispensing system, and to the underground fuel storage tank, after recovery. The valve body incorporates a valve stem, with the upper portion of the stem being engaged with a diaphragm assembly, and just below that there is an o-ring check valve that closes off any communication between the area of the valve stem, and the space beneath the diaphragm, when the valve assembly is normally operating, and the vacuum assist is drawing vapors back into the dispenser and to the underground storage tank, for collection. And the bottom of the valve stem is a plug, which is normally opened when the vacuum assist system is operating, and the vehicle to which fuel is being dispensed is a non-ORVR installed vehicle. But, when fuel is being dispensed into a vehicle incorporating the ORVR technology, the combination of the vacuum from the vacuum assist system, and the ORVR vacuum draw, has a tendency to pull the diaphragm of the valve design upwardly, thereby plugging the upstream vapor passage through the valve body, to prevent any further draw by the vacuum assist system, and at the same time, the o-ring check valve provided upwardly upon stem is lifted, and allows ambient air to enter into that location, pass along the valve stem, and pass into the downstream conduit of the valve assembly so that the vacuum assist system draws ambient air, and not vapors, during its continuing operation. Furthermore, by drawing ambient air, the vacuum assist system and its technology will not deteriorate, or burn out, by drawing too high of a vacuum if ambient air was not allowed to attain access to its assembly. Also, there is a small passage leading from the upstream side of the conduit, which communicates above the diaphragm, so that the ORVR generated vacuum can enter above the diaphragm assembly, and with the vacuum assist air draw, will have a tendency to pull the diaphragm up, to allow for a close off of the vacuum assist system. But, when fuel dispensing ceases, and the ORVR system of the vehicle ends its operations, the vacuum generated above the diaphragm is depleted, and the diaphragm moves towards its normal position, which opens the plug at the bottom of the piston stem, and closes off the o-ring check valve upwardly of the stem, to prevent any further ambient air from being drawn into the valve assembly, and to the vacuum assist system. The concept of this invention is to minimize the usage of any air passage throughout the valve assembly, but simply to vent air into the valve, and into the downstream side of the vapor recovery line, which prevents the pump of the vacuum assist system from deteriorating, or burning out, during routine operations regardless what type of vehicle is being replenished with fuel.

As known in the art, the ORVR valve is designed and intended to be paired with the vacuum assist vapor recovery nozzles. The intention of the product is to eliminate the possibility of over-pressurization of the underground storage tank, during dispensing of fuel into a vehicle that incorporates the ORVR system. With the introduction of the on-board vapor recovery in newer vehicles, or the ORVR system, the vacuum pumps at fueling stations begin to pull back mainly clean air. As air expands more and at a faster rate than gasoline vapors causing an over-pressurization of the underground storage tanks, which in turn causes the pressure vacuum vents to open ultimately, releasing the captured vapors back into the atmosphere. This ORVR valve is equipped with the vacuum diaphragm assembly, and a piston, that work together to reduce the cross sectional area that is available for air to travel through it. As the vacuum pump begins to draw air back through the ORVR valve, that vacuum is created on the top of its diaphragm, which then pulls the diaphragm assembly and piston up, and ultimately creates a choke through the vacuum assist vapor return line. The ORVR valve is a conduit for gasoline to flow through, acting simply as an extension between the hose and the nozzle, as far as fuel delivery is concerned. But, it can accommodate the collection of vapors, either by returning them through the use of the vacuum assist system, or to bypass the vacuum assist system when the vehicle being replenished with fuel incorporates its own on-board ORVR system.

It is, therefore, the principal object of this invention to provide for operations of fuel dispensing to vehicles, those that both incorporate the ORVR method of vapor removal or one lacking such a system and is adaptable for application with the vacuum assist return of vapors to the underground storage tank.

Still another object of this invention is to provide a valve assembly that is versatile sufficiently to allow for dispensing of fuel to different styles of vehicles, those that incorporate the ORVR system of vapor removal, and those that do not.

Another object of this invention is to provide a valve assembly that is of simplified structure, and minimizes the need for multiple air passage ports within its structure, which thereby lessens the amount of operable components in the assembly, thereby reducing the cost of its manufacture.

These and other objects may become more apparent to those skilled in the art upon review of the summary of the invention as provided herein, and upon undertaking a study of the description of its preferred embodiment, in view of the drawings.

DESCRIPTION OF THE PREFERRED EMBODIMENT

Figure 1:
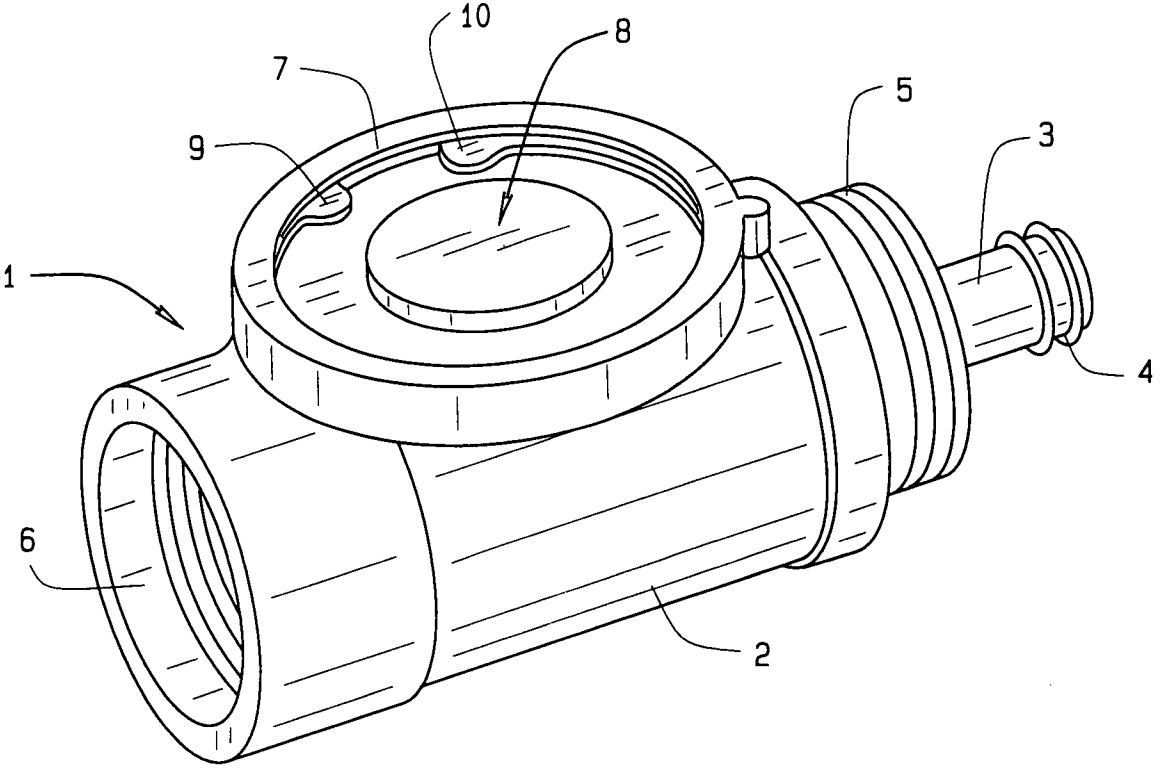
FIG. 1 provides an isometric view of the ORVR valve assembly of this invention.

In referring to the drawings, and in particular FIG. 1, therein is shown a perspective view of the ORVR valve assembly 1 of this invention. It essentially includes the ORVR valve body 2 which incorporates a front end extension 3 that includes a series of o-rings, as at 4 that are useful for inserting into and maintaining a fluidic seal with the vapor recovery portion of the fuel dispensing hose, leading towards the nozzle. At the backend of the valve body is the inlet 6 that incorporates a series of threads, as noted, and into which a connector (not shown) threadily engages, for connection of the opposite end of the fuel dispensing hose to locate therein, usually up towards the dispenser, to attain the operations of this valve assembly.

On the topside of the valve body 2 is an opening 7 and into which the diaphragm assembly 8 locates, all of which is held into position by means of a ring retainer 9 when inserted. And, a vacuum cap 10 is provided for sealing off the diaphragm chamber, and which is held in position, as previously explained, by means of the said retainer.

Figure 2:
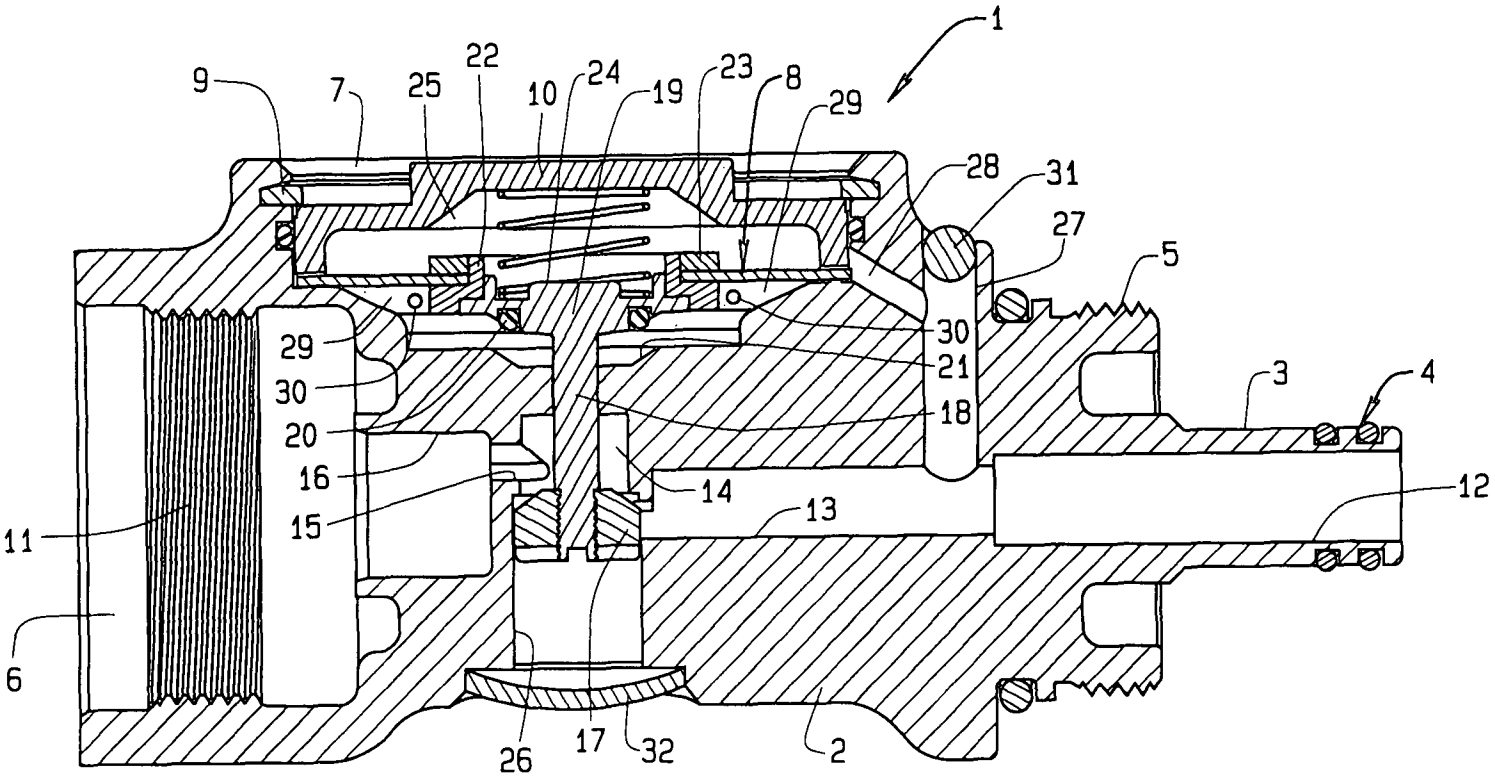
FIG. 2 provides a longitudinal sectional view of the valve assembly, showing its various operative components.

As can be seen in FIG. 2, the external threads 5 at the stem part of the valve body are available for mounting the entire fuel dispensing hose thereon, and held into position by means of a nut (not shown) that threadily engages onto the surface 5. Likewise, the threads 11 provide for engagement of the opposite end of the fuel dispensing hose therein, so that both fuels can be dispensed through the valve body, in addition to providing the means for vapor recovery, as to be subsequently described.

As can be noted, the stem 3 has an opening 12 provided therein, and which communicates further inwardly through the conduit 13 which opens into the passage 14 of the valve body. This is considered the upstream side of the vapor return line for the vacuum assist system of returning vapors to the underground storage tank. The passage 14 communicates with a further conduit 15 which is in open communication with the opening 16 and which further communicates with the vapor return line at the downstream side of the vapor return system, for the vacuum assist style of vapor recovery.

Within the passage 14 is a piston or plug 17 that is engaged upon the bottom of the piston stem 18 as can be noted. It may be threadily engaged thereon, or retained by other means. The piston stem 18 has an upper flared portion, as at 19, which mounts at least an o-ring 20 that is aligned for biasing against and sealing upon the inclined surface 21 as will be subsequently described. Connecting with the flared portion 19 is a mounting ring 22 that holds an edge of the diaphragm 8, by means of the retaining ring 23. A spring assembly 24 normally biases the piston stem 18 and its plug 17 downwardly within the spacing 26, so that when normal operations in the dispensing of fuel to a vehicle not incorporating an ORVR system progresses, the spring biases the stem 18 and plug 17 downwardly, forcing the o-ring against the seat 21, while at the same time, pushes the plug 17 further downwardly, to open up communication between the conduits 13, and 15, to allow for the return of vapors through operations of the vacuum assist system of the fuel dispenser, to collect and return vapors back to the underground storage tank, from the vicinity of the fill pipe of the vehicle being replenished with fuel.

During this time, since the o-ring 20 is seated against its surface 21, and the diaphragm assembly 8 is inoperative, this provides for routine return of vapors back through this valve assembly and to the underground fuel storage tank.

Figure 3:
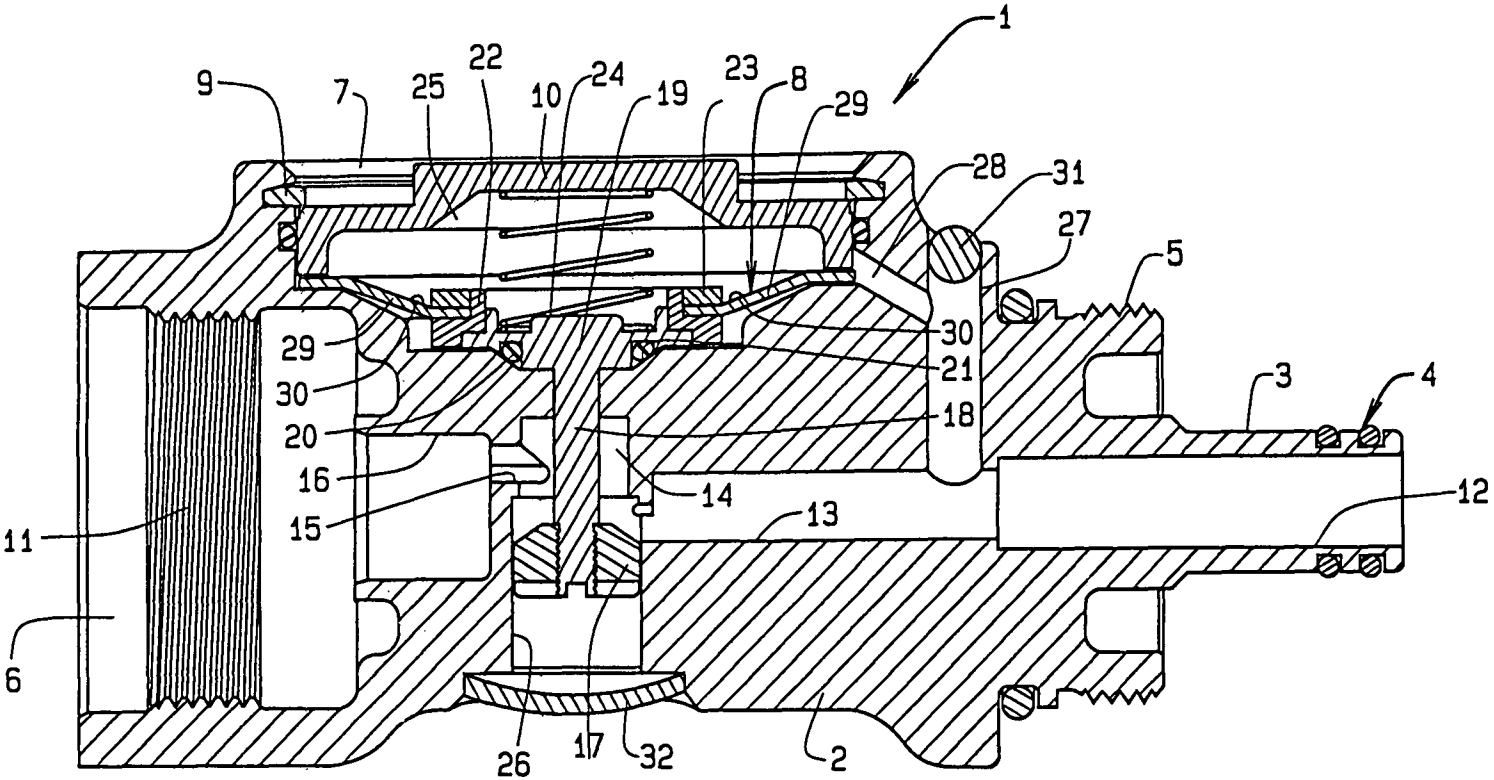
FIG. 3 shows the ORVR Valve Assembly when the vacuum assist method of attracting vapors back into the dispenser is operative, and the valve assembly shown therein is open to allow the vapors to pass through said valve.

While FIG. 2 shows the ORVR Valve Assembly in closure, with the plug 17 sealing off the conduit 13 from attracting vapors back into the vacuum assist operations of the dispenser, FIG. 3 shows when the vacuum assist method of attracting vapors back to the dispenser is operative, and the vehicle does not have an ORVR system installed in it, so that the plug 17 is opened and allows vapors to pass through the conduits 13 and opening 16 to allow such vapors to be attracted back into the dispenser, through its vacuum assist operations.

But, when an ORVR equipped vehicle is being filled with fuel, and provides for on-board processing of fuel vapors, which generally are injected back into the fuel supply of the vehicle, delivered to the engine, the ORVR operating system generates its own vacuum, and that vacuum likewise passes through the fuel dispensing hose, into the conduit 12, and attains access through the passage 27 and its communicating passage 28 and above the diaphragm assembly 8, into the space identified at 25. Likewise, when this is initiated, the attraction of vapors by the vacuum assist system also communicate through the passages 16, the conduit 15, and since the plug 17 is lowered, the suction of vapors further progress through the conduit 13, up the passage 27 and 28, also into that area 25 above the diaphragm. When this occurs, sufficient vacuum pressure is generated within the space 25, which pulls the diaphragm assembly upwardly, against the pressure of its spring 24, which shifts the plug 17 upwardly for blocking the conduit 13 from returning any vapors attracted by the vacuum assist system, and essentially blocking off that vapor flow passage. As this occurs, and the stem 18 is pulled upwardly, by means of the shifting diaphragm 8, the o-ring seal 20 lifts off of its seat 21, and air is allowed to enter into the space 29 through the ports 30 that vent to atmosphere, so that air passes downwardly within the space 29, pass the stem 18, and into the conduit 15, for absorption back into the vapor assist vacuum system, which means instead of pulling gasoline vapors, that operating system will attract ambient air through operations of said system.

Once fuel dispensing ceases, and the vacuum generated above the diaphragm assembly 8 dissipates, the spring will force the stem 18, and its plug 17, downwardly, to reopen the conduits and provide a passage for communication between the conduit 13, and the conduit 15, which allows for reactivation of the vacuum assist system, in preparation for the next dispensing of fuel. If the next vehicle being fueled is a non-ORVR equipped automobile, then the vacuum assist system will simply pull vapors back through the conduits 12, 13, 15 and 16, for return to the underground storage tank. But, when an ORVR equipped automobile is being refueled, then the generated vacuums will pull the diaphragm up, which pulls up the stem 18, and the plug 17, for blocking off the conduit 13, which allows the ORVR system to purge the fuel vapors at the location of the automobile fuel tank, and, at the same time, vent the vacuum assist line 6 and 16 to atmosphere, in the manner as previously described.

A number of other structural accessories provided within this valve assembly include a plug 31 that blocks the passage 27 to atmosphere. Secondly, a freeze plug 32 is provided below the plug 17, to block off that location, and prevent the entrance of any air, or debris, into the passage 26, as can be noted. Thus, the entire bottom of the plug 17 is closed off to atmosphere, and prevents any corrosive materials from entering therein.

Variations or modifications to the structure of this ORVR valve assembly may occur to those skilled in the art upon review of the invention as described herein, and such variations, within the spirit of this invention, are intended to be encompassed within the scope of any claims to patent protection issuing hereon. The description of the invention within the preferred embodiment, and as summarized, in addition to their depiction in the drawings, as set forth for illustrative purposes only.

We claim:

1. An ORVR valve assembly for use in connection with a fuel dispensing hose of a vehicle fueling system, said valve assembly provided for conveyance or curtailing the passage of generated vapors during refueling of a vehicle, said valve assembly allowing for passage of fuel vapors when the dispensing nozzle is used in connection with a vacuum assist system of fuel dispensing, and said valve assembly provided for curtailing the flow of vapors when the dispensing nozzle is used in conjunction with the fueling of a vehicle incorporating an ORVR system of fuel dispensing;

said valve assembly including a valve body, said valve body having a conduit provided longitudinally therethrough, a passage disposed transverse to the conduit of the valve body, a space provided at an upper end of said passage, and the passage at its lower end opening exteriorly of the said valve body, the conduit of the valve body having a vapor upstream side and a vapor downstream side for passage of the generated vapors therethrough;

a diaphragm assembly disposed within the space and secured to the valve body for movement within said space, a stem provided for extending through the passage, said stem having an upper flared portion connecting with the diaphragm assembly, and said flared portion having a seal for sealing against the valve body at the upper end of said passage, a spring biasing against said flared portion of the stem and normally biasing said flared portion into closure against its seal, a plug provided at the lower end of the said stem, and normally biased downwardly within the passage to clear the conduit for flow of generated vapors therethrough when the nozzle is functioning in a vapor assist system for fuel dispensing, said plug always remaining within the passage of said valve body, a closure provided at the bottom of the passage to provide a seal and to block off the passage and preventing any contaminants from entering therein;

a communicating passage provided through said valve body and extending from the vapor upstream side of the conduit and communicating with the space above said diaphragm assembly, such that when the dispensing nozzle is fueling a vehicle equipped with an ORVR installation, a vacuum is generated above the diaphragm assembly to raise the stem plug to close off the valve body conduit to prevent the passage of fuel vapors therethrough when the ORVR processes the generated fuel vapors within the vehicle during refueling;

at least one air entrance port provided above said upper end of said passage where the seal contacts the valve body, the at least one air entrance port allowing passage of ambient air into the valve assembly and entrance to the upstream side of the valve body conduit to deliver air to the operating vacuum assist of the fueling system during functioning of the vehicle ORVR installation for processing generated fuel vapors during refueling.

2. The ORVR valve assembly of claim 1, wherein said seal of the flared portion of the stem includes a check valve, normally disposed within the provided said space, and capable of closing off the venting of ambient air into the upstream side of the conduit when a non-ORVR equipped vehicle is being refueled, and the vacuum assist system of vapor recovery is in operation.

3. The ORVR valve assembly of claim 2 and wherein said plug capable of shifting downwardly through the bias of said spring against the diaphragm assembly and its associated stem, thereby opening the valve body conduit to allow passage of generated vapors during refueling to be returned by the vacuum assist system to the fuel storage tank when a non ORVR vehicle is being refueled.

4. The ORVR valve assembly of claim 3, wherein said closure is a freeze plug.

* * * * *